US012180598B2

(12) United States Patent
Yoshinaga et al.

(10) Patent No.: US 12,180,598 B2
(45) Date of Patent: Dec. 31, 2024

(54) ELECTROCHEMICAL REACTION DEVICE AND ELECTROCHEMICAL REACTION METHOD

(71) Applicants: KABUSHIKI KAISHA TOSHIBA, Tokyo (JP); TOSHIBA ENERGY SYSTEMS & SOLUTIONS CORPORATION, Kawasaki (JP)

(72) Inventors: Norihiro Yoshinaga, Yokohama (JP); Shinichi Sekiguchi, Bunkyo (JP); Naoki Syoji, Hachioji (JP); Ryota Kitagawa, Setagaya (JP); Yoji Nakamori, Kamakura (JP); Hideaki Sato, Yokohama (JP); Yoshitsune Sugano, Kawasaki (JP); Tetsuharu Tanoue, Setagaya (JP)

(73) Assignees: KABUSHIKI KAISHA TOSHIBA, Tokyo (JP); TOSHIBA ENERGY SYSTEMS & SOLUTIONS CORPORATION, Kawasaki (JP)

( * ) Notice: Subject to any disclaimer, the term of this patent is extended or adjusted under 35 U.S.C. 154(b) by 80 days.

(21) Appl. No.: 17/903,186

(22) Filed: Sep. 6, 2022

(65) Prior Publication Data

US 2023/0243042 A1 Aug. 3, 2023

(30) Foreign Application Priority Data

Jan. 28, 2022 (JP) ..... 2022-011964
Jul. 26, 2022 (JP) ..... 2022-118767

(51) Int. Cl.
*C25B 1/04* (2021.01)
*C25B 9/19* (2021.01)
(Continued)

(52) U.S. Cl.
CPC ..... *C25B 1/04* (2013.01); *C25B 9/19* (2021.01); *C25B 13/02* (2013.01); *C25B 15/02* (2013.01); *C25B 15/085* (2021.01); *C25B 15/087* (2021.01)

(58) Field of Classification Search
None
See application file for complete search history.

(56) References Cited

U.S. PATENT DOCUMENTS

| | | | |
|---|---|---|---|
| 5,205,994 | A | 4/1993 | Sawamoto et al. |
| 2021/0262101 | A1 | 8/2021 | Tanaka et al. |
| 2022/0298658 | A1 | 9/2022 | Yoshinaga et al. |

FOREIGN PATENT DOCUMENTS

| | | | |
|---|---|---|---|
| EP | 4 060 085 | A1 | 9/2022 |
| JP | 2013-199697 | A | 10/2013 |

(Continued)

OTHER PUBLICATIONS

Machine translation of Soo KR 20080007077 A (Year: 2008).*

*Primary Examiner* — Wojciech Haske
(74) *Attorney, Agent, or Firm* — Oblon, McClelland, Maier & Neustadt, L.L.P.

(57) ABSTRACT

An electrochemical reaction device of an embodiment includes: an electrochemical reaction cell 1 that includes: a first electrode having a first flow path, a second electrode having a second flow path, and a separating membrane sandwiched between the first electrode and the second electrode; a liquid tank that contains a liquid to be treated supplied to the second flow path of the second electrode; a first pipe that connects an inlet of the second flow path and the liquid tank; a second pipe that connects an outlet of the second flow path and the liquid tank; and a backflow suppression mechanism that is provided in the second pipe
(Continued)

to prevent backflow of the liquid to be treated flowing in the second pipe or reduce a backflow speed.

5 Claims, 8 Drawing Sheets

(51) Int. Cl.

| | |
|---|---|
| ***C25B 13/02*** | (2006.01) |
| ***C25B 15/02*** | (2021.01) |
| ***C25B 15/08*** | (2006.01) |

(56) References Cited

FOREIGN PATENT DOCUMENTS

| | | | | | |
|---|---|---|---|---|---|
| JP | 2020-196906 | A | | 12/2020 | |
| JP | 2021-46602 | A | | 3/2021 | |
| JP | 2021-80520 | A | | 5/2021 | |
| JP | 2023-31711 | A | | 3/2023 | |
| KR | 20080007077 | A | * | 1/2008 | ..... C25B 1/04 |

* cited by examiner

ELECTROCHEMICAL REACTION DEVICE AND ELECTROCHEMICAL REACTION METHOD

CROSS REFERENCE TO RELATED APPLICATION

This application is based upon and claims the benefit of priority from Japanese Patent Application No. 2022-011964, filed on Jan. 28, 2022 and Japanese Patent Application No. 2022-118767, filed on Jul. 26, 2022; the entire contents of which are incorporated herein by reference.

FIELD

Embodiments described herein relate generally to an electrochemical reaction device and an electrochemical reaction method.

BACKGROUND

A typical example of an electrochemical reaction device such as an electrolytic device is a water electrolytic device, which electrolyzes water ($H_2O$) to produce hydrogen ($H_2$) and oxygen ($O_2$). The water electrolytic device includes an electrolytic cell having, for example, an anode, a cathode, and a separating membrane such as a polymer electrolyte membrane (PEM) sandwiched between the anode and cathode. In the water electrolytic device, water ($H_2O$) is electrolyzed to produce hydrogen ($H_2$) at the cathode and oxygen ($O_2$) at the anode. Such a water electrolytic cell using the polymer electrolyte membrane (PEM) as the separating membrane (PEM-type water electrolytic cell) has characteristics such as low operating temperature and high hydrogen purity. However, the water electrolytic cell with the separating membrane such as the PEM-type water electrolytic cell has a problem in that performance tends to deteriorate when start-stop operation is performed. Such a problem is not limited to the water electrolytic cell but is also an issue for electrolytic cells and electrolytic devices (electrochemical reaction devices) with a separating membrane in general.

DETAILED DESCRIPTION

An electrochemical reaction device of an embodiment includes: an electrochemical reaction cell that includes: a first electrode having a first flow path, a second electrode having a second flow path, and a separating membrane sandwiched between the first electrode and the second electrode; a liquid tank that contains a liquid to be treated supplied to the second flow path of the second electrode; a first pipe that connects an inlet of the second flow path and the liquid tank to supply the liquid to be treated to the second flow path; a second pipe that connects an outlet of the second flow path and the liquid tank to return the liquid to be treated to the liquid tank; and a backflow suppression mechanism that is provided in the second pipe and prevents backflow of the liquid to be treated flowing in the second pipe or reduces a backflow speed.

Hereinafter, electrochemical reaction devices in embodiments will be described with reference to the drawings. Substantially the same components are denoted by the same reference signs and description thereof may be omitted in some cases in the embodiments described below. The drawings are schematic, and the relation between thicknesses and plane dimensions, ratios between the thicknesses of the parts, and the like may differ from actual ones.

Figure 1:
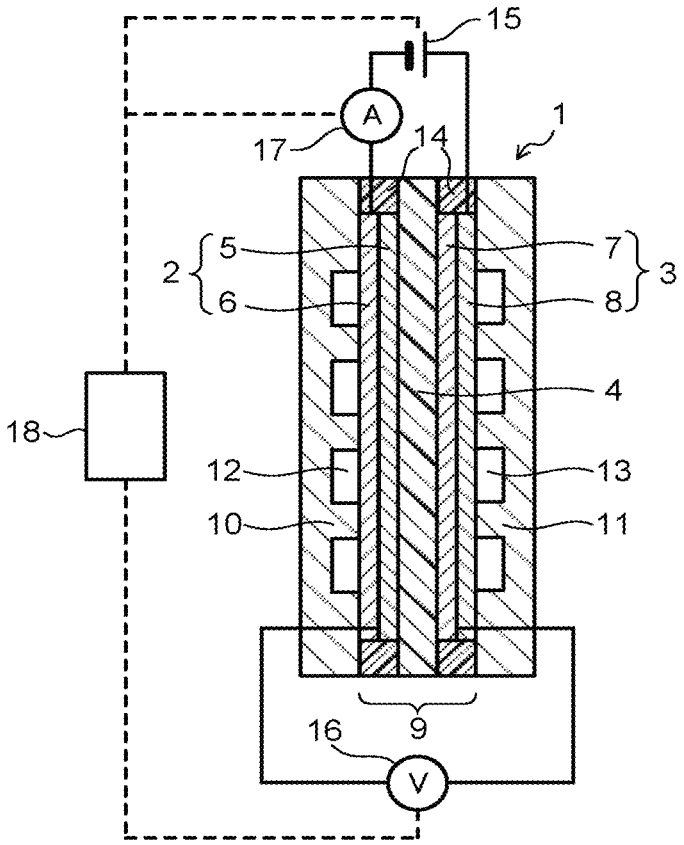
FIG. 1 is a diagram illustrating a configuration of an electrochemical reaction cell and a connecting structure between the electrochemical reaction cell and a power supply in an electrochemical reaction device of an embodiment.

A configuration of an electrochemical reaction cell and a connecting structure between the electrochemical reaction cell and a power supply of an electrochemical reaction device of the embodiment are described with reference to FIG. 1. An electrochemical reaction cell 1 illustrated in FIG. 1 includes a first electrode 2, a second electrode 3, and a separating membrane 4 sandwiched between the first electrode 2 and the second electrode 3. The separating membrane 4 has, for example, a polymer electrolyte membrane (PEM). When the electrochemical reaction cell 1 is used as a water electrolytic cell, the first electrode 2 is a cathode (reduction electrode/hydrogen pole) and the second electrode 3 is an anode (oxidation electrode/oxygen pole). In the following, the case where the electrochemical reaction cell 1 is used as the water electrolytic cell is mainly described but is not limited to the water electrolytic cell. A proton-conducting membrane is used for the polymer electrolyte membrane as the separating membrane 4.

A fluorocarbon resin with a sulfonic acid group, for example, is used as a composing material of the proton-conducting PEM. Concrete examples of such materials include Nafion (registered trademark), which is a fluorocarbon resin made by sulfonating and polymerizing tetrafluoroethylene manufactured by Dupont de Nemours, Inc., Aciplex (registered trademark) manufactured by Asahi Kasei Corporation, Flemion (registered trademark) manufactured by AGC Inc., and the like. The separating membrane 4 is not limited to the polymer electrolyte membrane, but can also be an electrolyte membrane such as a hydrocarbon membrane containing electrolyte components or a membrane containing inorganic materials such as tungstic acid or phosphotungstic acid.

The second electrode 3, which is the anode, electrolyzes water ($H_2O$) through an oxidation reaction to produce hydrogen ions ($H^+$) and oxygen ($O_2$). The first electrode 2, which is the cathode, reduces the hydrogen ions ($H^+$) produced at the anode to produce hydrogen ($H_2$). The first electrode 2, the cathode, has a first catalyst layer 5 and a first power feeding layer 6. The first catalyst layer 5 is disposed to be in contact with the separating membrane 4. The second electrode 3, the anode, has a second catalyst layer 7 and a second power feeding layer 8. The second catalyst layer 7 is disposed to be in contact with the separating membrane 4. A membrane electrode assembly (MEA) 9 is formed by sandwiching the separating membrane 4 such as the PEM between the first electrode 2 and second electrode 3.

For example, metals such as platinum (Pt), silver (Ag), and palladium (Pd), alloys containing at least one of Pt, Ag, or Pd (Pt alloys, Ag alloys, or Pd alloys), and the like are used for the first catalyst layer 5 of the first electrode 2, which is the cathode. Pt or the Pt alloy such as PtCo, PtFe, PtNi, PtPd, PtIr, PtRu, or PtSn is more preferably used for the first catalyst layer 5. For example, iridium (Ir) oxide, ruthenium (Ru) oxide, palladium (Pd) oxide, Jr composite oxide, Ru composite oxide, Pd composite oxide, and the like are used for the second catalyst layer 7 of the second electrode 3, which is the anode. Examples of composite metals that make up the Ir composite oxide and Ru composite oxide include titanium (Ti), niobium (Nb), vanadium (V), chromium (Cr), manganese (Mn), cobalt (Co), zinc (Zn), zirconium (Zr), molybdenum (Mo), tantalum (Ta), Ru, Ir, Pd, and the like. The Ir oxide, Ir composite oxide, and the like are more preferably used for the second catalyst layer 7.

Materials having gas diffusibility and conductivity are used for the first power feeding layer 6 of the first electrode 2 and the second power feeding layer 8 of the second electrode 3. Concretely, porous conductive members and the like are applied to the first power feeding layer 6 and the second power feeding layer 8. A porous metal member, metal felt, or metallic nonwoven fabric obtained by entangling metal fibers, of Ti, Ta, SUS, Ni, Pt, or the like, carbon paper, carbon cloth, and the like are used for the first power feeding layer 6 and the second power feeding layer 8. It is preferable to use Ti, which has excellent corrosion resistance and thus improves durability, for the first power feeding layer 6 and the second power feeding layer 8. These materials can also be plated with gold, platinum, or other metals to further improve durability.

The MEA 9 is sandwiched between a cathode separator 10 and an anode separator 11, and the electrochemical reaction cell 1 is constituted by them. The cathode separator 10 has a first flow path 12 for circulating reactants and products. The anode separator 11 has a second flow path 13 for circulating reactants and products. Seal members 14 are disposed on side surfaces of the first catalyst layer 5 and the first power feeding layer 6 and side surfaces of the second catalyst layer 7 and the second power feeding layer 8 to prevent leakage of gas or liquid from the MEA 9 and the electrochemical reaction cell 1.

The electrochemical reaction cell 1 is not limited to a single-cell structure but may have a stack-cell structure in which a plurality of electrochemical reaction cells 1 are stacked. The structure of the stack cell is not limited but is appropriately selected depending on a desired voltage, reaction amount, and the like. When the plurality of electrochemical reaction cells 1 are used, it is also possible to employ a structure in which the plurality of electrochemical reaction cells 1 are disposed in a planar manner, or the like, without being limited to the stack-cell structure. Moreover, it is also possible to stack the cells disposed in a planar manner. The number of single cells included in the electrochemical reaction cell 1 is not limited either but is appropriately selected.

For example, an aqueous solution containing at least one type from among water, hydrogen, reformed gas, methanol, ethanol, formic acid, and the like can be used as the reactant supplied to the electrochemical reaction cell 1. When the electrochemical reaction cell 1 of the embodiment is the water electrolytic cell, the water electrolytic cell is preferably filled with pure water (for example, pure water with a specific resistance of 0.01 MΩ·cm or more and 5 MΩ·cm or less), or even ultrapure water (for example, ultrapure water with a specific resistance of 17 MΩ·cm or more). The electrochemical reaction cell 1 of the embodiment is not limited to the electrolytic cell for water electrolytic but can be applied to various electrolytic cells such as electrochemical reaction cells that also use oxides as catalysts, such as carbon dioxide electrolytic cells. Furthermore, the electrochemical reaction cell 1 is not limited to the electrolytic cell but can also be a fuel cell or the like.

The first electrode 2 and the second electrode 3 of the electrochemical reaction cell 1 are electrically connected to a voltage application unit (power supply) 15. A voltage measuring unit 16 and a current measuring unit 17 are provided on a circuit that electrically connects the power supply 15 and the first electrode 2 and the second electrode 3. The operation of the power supply 15 is controlled by a control unit 18. The control unit 18 controls the power supply 15 to apply voltage to the electrochemical reaction cell 1. The voltage measuring unit 16 is electrically connected to the first electrode 2 and the second electrode 3, and measures a voltage applied to the electrochemical reaction cell 1. Its measurement information is transmitted to the control unit 18. The current measuring unit 17 is inserted into a voltage application circuit for the electrochemical reaction cell 1 and measures a current flowing through the electrochemical reaction cell 1. Its measurement information is transmitted to the control unit 18.

The control unit 18 is constituted by a computer such as, for example, a PC or a microcomputer, and subjects data signals output from each unit to arithmetic processing to output necessary control signals to each component. The control unit 18 further has a memory, and controls an output of the power supply 15 in accordance with each measurement information according to programs stored in the memory, to perform such control as application of voltage to the electrochemical reaction cell 1 and a change in load. Note that when the electrochemical reaction cell 1 is used for a cell reaction, voltage is loaded on the electrochemical reaction cell 1. When the electrochemical reaction cell 1 is used for a reaction other than the cell reaction, for example, a hydrogen production reaction by water electrolysis, an electrolytic reaction of carbon dioxide, or the like, voltage is applied to the electrochemical reaction cell 1. The electrochemical reaction device of the embodiment is constituted, for example, to apply voltage between the first electrode 2 and the second electrode 3 and make the electrochemical reaction progress.

First Embodiment

Next, an electrochemical reaction device 20 according to the first embodiment including the electrochemical reaction cell 1 illustrated in FIG. 1 will be described with reference to FIG. 2. A configuration in a case of applying the electrochemical reaction device 20 to a water electrolytic device, which electrolyzes water, is mainly described here, but the electrochemical reaction device of the embodiment is not limited thereto, and may be a carbon dioxide electrolytic device, or the like. The electrochemical reaction device (electrolytic device) 20 illustrated in FIG. 2 includes a water supply system (liquid to be treated supply system) 21 that supplies water to the second electrode 3 of the electrochemical reaction cell (electrolytic cell) 1 as a liquid to be treated.

The water supply system 21 has a water tank 22 as a liquid tank that contains the liquid to be treated supplied to the second flow path 13 of the second electrode 3. The water tank 22 is connected to a pure-water production device 23, and pure water is supplied from the pure-water production device 23 to the water tank 22 as a treatment liquid concentrate. The pure-water production device 23 is, for example, a reverse osmosis membrane (RO membrane) device. Tap water W or other water is supplied to the pure-water production device 23 as raw water. A specific resistance of tap water W is about 0.01 MΩ·cm @ 25° C. or less, and when such water W is treated by the pure-water production device 23 such as the RO membrane device, pure water (treatment liquid concentrate) with the specific resistance of about 0.01 to 5 MΩ·cm@25° C. is produced. Such pure water is supplied to the water tank 22.

A first pipe 24 and a second pipe 25 are connected to the water tank 22. The first pipe 24 is a supply pipe that supplies water to the second electrode 3 of the electrochemical reaction cell 1 and is connected to the water tank 22 and an inlet IN of the second flow path 13. A pump 26 and an ultrapure-water production device 27 are provided in the first pipe 24, which is the supply pipe. The ultrapure-water production device 27 is, for example, an ultrapure-water device using an ion-exchange resin. Pure water contained in the water tank 22 is sent to the ultrapure-water production device 27 through the pump 26. When pure water with the specific resistance of about 0.01 to 5 MΩ·cm@25° C. is treated by the ultrapure-water production device 27 such as the ion-exchange resin device, ultrapure water with the specific resistance of about 17 MΩ·cm@25° C. or more such as 18.24 MΩ·cm@25° C., for example, is produced as the liquid to be treated. Such ultrapure water is sent to the inlet IN of the second flow path 13 of the second electrode 3 as the liquid to be treated and electrolysis of water is performed at the second electrode 3 as the anode while the water is circulating through the second flow path 13.

The second pipe 25 that returns oxygen ($O_2$), which is produced by water electrolysis, and excess water to the water tank 22 is connected to an outlet OUT of the second flow path 13 of the second electrode 3. The second pipe 25 is a return pipe (also called oxygen pipe) that returns oxygen ($O_2$), which is produced by water electrolysis, and excess water to the water tank 22 and is connected to the outlet OUT of the second flow path 13 and the water tank 22. The water tank 22 has a gas-liquid separation function and oxygen ($O_2$) separated in the water tank 22 is collected as needed. The water contained in the water tank 22 is circulated through the first pipe 24, the pump 26, the ultrapure-water production device 27, the second flow path 13, and the second pipe 25. The second pipe 25 is provided with a check valve 28 as a backflow suppression mechanism, as will be described in detail later.

In water electrolysis by the second electrode 3, oxygen ($O_2$) and hydrogen ions (protons/$H^+$) are produced. Protons ($H^+$) are sent from the second electrode 3 to the first electrode 2 of the electrochemical reaction cell 1 through the separating membrane 4. Since water is also sent from the second electrode 3 to the first electrode 2 through the separating membrane 4, a water tank with a gas-liquid separation function is connected to an outlet of the first flow path 12 of the first electrode 2, if necessary. The protons ($H^+$) sent to the first electrode 2 react with electrons ($e^-$) that reach the first electrode 2 through an external circuit to produce hydrogen ($H_2$). The hydrogen ($H_2$) produced at the first electrode 2 is collected directly from the first electrode 2 or after being discharged to the outside through the water tank.

Next, operation of the electrochemical reaction device 20 illustrated in FIG. 2 will be described. In the case of water electrolysis, water ($H_2O$) is electrolyzed and a reaction of formula (1) presented below occurs when voltage is applied to the second electrode 3 as the anode from an external power supply.

$$2H_2O \rightarrow O_2 + 4H^+ + 4e \quad (1)$$

Protons ($H^+$) produced at this time are sent through the separating membrane 4 to the first electrode 2 as the cathode. Further, electrons ($e^-$) reach the first electrode 2 through the external circuit. Hydrogen is produced at the first electrode 2 as the cathode by a reaction of formula (2) presented below.

$$4H^+ + 4e^- \rightarrow 2H_2 \quad (2)$$

The reactions of the above-described formula (1) and formula (2) allow hydrogen and oxygen to be produced.

As mentioned above, the outlet OUT of the second flow path 13 of the second electrode 3 and the water tank 22 are connected through the second pipe 25. In such a configuration, when the second pipe 25 is not provided with the backflow suppression mechanism such as the check valve 28, the pure water in the water tank 22 supplied from the pure-water production device 23 may flow back to the second electrode 3 through the second pipe 25 and the second flow path 13 or impurities may diffuse due to a concentration gradient when the operation of the electrolytic device 20 is stopped. When pure water flows into the second electrode 3, pure water with the specific resistance of about 0.1 to 5 MΩ·cm contained in the water tank 22 reaches the separating membrane 4 and the first electrode 2 because the second electrode 3 is porous. A small amount of anionic and cationic components contained in such pure water, as well as $SiO_2$ and other fine particles, can enter the inside of the separating membrane 4, thereby lowering ionic conductance and adsorb onto catalysts on the first electrode 2 and second electrode 3, resulting in adverse effects such as an extremely low reaction area for electrolysis and other electrochemical reactions. Such backflow of pure water from the water tank 22 into the electrochemical reaction cell 1 is a factor that deteriorates performance of the electrochemical reaction cell 1.

Therefore, in the electrochemical reaction device (electrolytic device) 20 of the first embodiment, the second pipe 25, which connects between the water tank 22 and the outlet OUT of the second flow path 13 of the second electrode 3, is provided with the check valve 28 as the backflow suppression mechanism. The check valve 28 can prevent the backflow of the pure water in the water tank 22 into the second electrode 3 through the second pipe 25 and the second flow path 13 when the operation of the electrolytic device 20 is stopped. By suppressing the backflow of the pure water in the water tank 22 into the second electrode 3, the electrochemical reaction device (electrolytic device) 20 can be stopped while the second flow path 13 and the second electrode 3 are filled with ultrapure water. Therefore, the performance of the electrochemical reaction cell 1 can be maintained when the electrochemical reaction device (electrolytic device) 20 is stopped.

Regarding the check valve 28 for suppressing the backflow of the pure water in the water tank 22 into the second electrode 3 described above, a minimum check differential pressure P(kPa) is preferably a value or more represented by the following expression (3).

$$\Delta h \times \rho \times g \quad (3)$$

Here, Δh is "a height of a liquid upper surface in the water tank 22—a height of the check valve 28", ρ is a liquid density, and g is the gravitational acceleration. By using the check valve 28 whose minimum check differential pressure P is the value or more represented by expression (3), the pure water in the water tank 22 can be effectively prevented from flowing back to the second electrode 3 when the operation of the electrolytic device 20 is stopped. Examples of the check valve 28 with such a constitution include a swing-type check valve, a lift-type check valve such as a Smolensky check valve, a wafer-type check valve, a ball-type check valve, and the like. On the other hand, valves such as those with multiple tear-drop loops through which the liquid flowing in a pipe is diverted (what is called Tesla valves) are not suitable.

Figure 3:
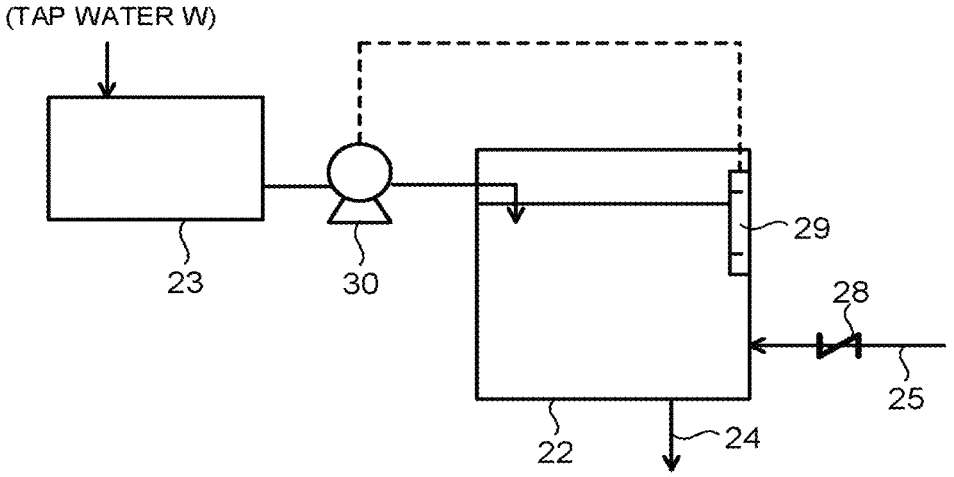
FIG. 3 is an enlarged diagram illustrating a part of the electrochemical reaction device according to the first embodiment.

In the electrochemical reaction device (electrolytic device) 20 of the first embodiment, the second pipe 25 provided with the check valve 28 is preferably connected below a liquid level of the water tank 22, that is, under water. The pure-water production device 23 supplies water W as raw water for water to be treated (water to be electrolyzed) to the water tank 22 based on the configuration illustrated in FIG. 3, for example. The water tank 22 includes a liquid level sensor 29 provided inside thereof. The liquid level sensor may be a laser liquid level indicator or the like provided outside the water tank 22. A feed water pump 30 that supplies water W from the pure-water production device 23 to the water tank 22 is activated to supply water into the water tank 22 when the liquid level in the water tank 22 falls below a lower limit value of the liquid level sensor 29. Therefore, the second pipe 25 is preferably connected at a position lower than the liquid level in the water tank 22 set by the liquid level sensor 29.

The backflow of the pure water in the water tank 22 can be suppressed by the check valve 28 while maintaining a liquid-tight state of the second pipe 25 by connecting the second pipe 25 at the position lower than the liquid level set by the liquid level sensor 29. Even when the second pipe 25 is connected at a position higher than the liquid level, the backflow of water in the second pipe 25 can be suppressed. However, when a stop time is elongated, the water remaining in the second pipe 25 will evaporate and the MEA 9 will dry out. When dry out, the separating membrane 4 shrinks and swells when water is supplied again, and this repeated dry/wet cycle places a mechanical load on the separating membrane 4, which may cause flow path blockage due to rupture or deformation of the separating membrane 4. This is also undesirable in terms of durability of the electrolytic cell 1.

Figure 4:
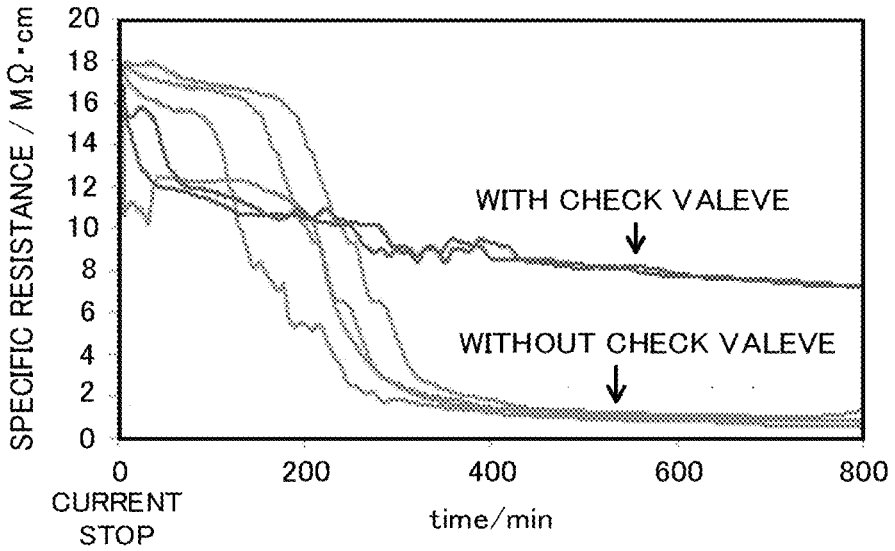
FIG. 4 is a diagram illustrating a specific resistance of water when the electrochemical reaction device according to the first embodiment is stopped compared to a specific resistance of water when an electrochemical reaction device without a check valve is stopped.
Figure 5:
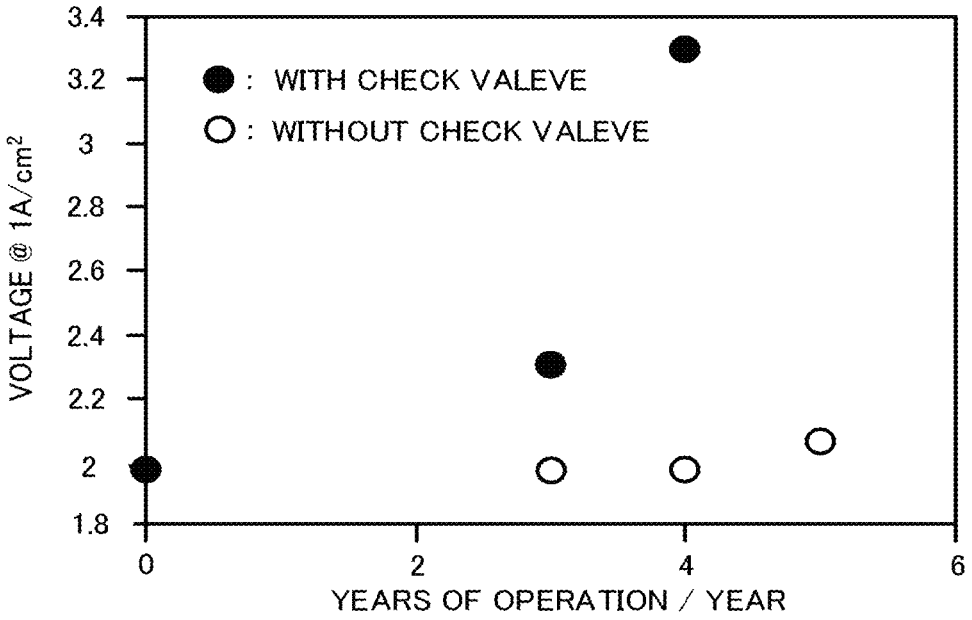
FIG. 5 is a diagram illustrating a voltage change over time of the electrochemical reaction device according to the first embodiment compared to a voltage change over time of the electrochemical reaction device without the check valve.

FIG. 4 illustrates the specific resistance of water when the electrochemical reaction device (electrolytic device) 20 is stopped (when the current stops) compared to a specific resistance of water when an electrolytic device without a check valve is stopped. FIG. 5 illustrates a voltage change over time of the electrochemical reaction device (electrolytic device) 20 compared to a voltage change over time of the electrolytic device without the check valve. As illustrated in FIG. 4, a decrease in the specific resistance due to backflow of water in the water tank 22 into the second electrode 3 can be suppressed by providing the check valve 28 in the second pipe 25. Furthermore, as illustrated in FIG. 5, a decrease in performance of the electrolytic cell 1 due to the backflow of the water in the water tank 22 can be suppressed by providing the check valve 28 in the second pipe 25.

Second Embodiment

The electrochemical reaction device 20 according to a second embodiment is described with reference to FIG. 6 to FIG. 8. In the electrochemical reaction device 20 illustrated in FIG. 6, the second pipe 25, which connects the water tank 22 and the outlet OUT of the second flow path 13 of the second electrode 3, has a U-shaped pipe 31 disposed in an inverted U-shape (convex upward) as a backflow suppression mechanism. Other than this, the configuration is the same as that of the electrochemical reaction device 20 of the first embodiment illustrated in FIG. 2. According to the U-shaped pipe 31 disposed in the inverted U-shape, oxygen ($O_2$) mixed in water is separated from the water in the U-shaped pipe 31, accumulates in an upper part of the U-shaped pipe 31, and a gas accumulation G is formed as illustrated in FIG. 7 when the water flowing in the second pipe 25 is stopped. The formation of such a gas accumulation G in the U-shaped pipe 31 separates ultrapure water UW on the second electrode 3 side from pure water PW on the water tank 22 side. Therefore, a liquid junction between the water tank 22 and the second electrode 3 is eliminated, and the pure water PW in the water tank 22 can be prevented from flowing back to the second electrode 3.

The U-shaped pipe 31 as the backflow suppression mechanism is an example of a backflow suppression pipe. The backflow suppression pipe should have a shape capable of forming the gas accumulation G inside the pipe resulting from the gas-liquid separation and is not limited to the U-shaped pipe. The backflow suppression pipe preferably has a shape that facilitates the formation of the gas accumulation G inside the pipe and prevents the gas in the gas accumulation G from spontaneously escaping. Examples of the shape of the backflow suppression pipe include the U-shaped pipe 31, a V-shaped pipe, and the like. When gas in a gas-liquid mixture flow discharged from the second electrode 3 is accumulated in the U-shaped pipe 31, all the gas will escape from the second pipe 25 when the pump 26 is operated for a while after electrolysis is stopped. The pump 26 is preferably stopped immediately after the production of gas by electrolysis is stopped to accumulate the gas produced by electrolysis as the gas accumulation G in the U-shaped pipe 31.

Instead of forming the gas accumulation G by separating the gas (for example, $O_2$) in the gas-liquid mixture flow discharged from the second electrode 3 as described above, for example, an external gas supply unit 32 can be used to supply gas to a portion of the U-shaped pipe 31 where the gas accumulation G is formed. The gas supplied from the gas supply unit 32 is not limited and may be oxygen ($O_2$), which is the gas produced by electrolysis, or other gas such as nitrogen ($N_2$), argon (Ar), air, or the like. When supplying gas from the external gas supply unit 32, the pump 26 may be stopped before the liquid level of the gas-liquid mixture flow in the U-shaped pipe 31 drops.

When using the backflow suppression pipe such as the U-shaped pipe 31, the second pipe 25 is preferably connected at a position lower than the liquid level of the water tank 22. The liquid level of the water tank 22 is set by a liquid level sensor as in the first embodiment. This maintains the liquid-tight state of the second pipe 25 and allows the gas accumulation G formed in the backflow suppression pipe such as the U-shaped pipe 31 to suppress the backflow of the pure water in the water tank 22. It is thereby possible to suppress the deterioration of the properties, durability, and the like of the electrolytic cell 1.

Third Embodiment

The electrochemical reaction device 20 according to a third embodiment is described with reference to FIG. 9. In the electrochemical reaction device 20 illustrated in FIG. 9, the second pipe 25, which connects the water tank 22 and the outlet OUT of the second flow path 13 of the second electrode 3, is provided with a long pipe 33 as a backflow suppression pipe. When the device is in operation, produced oxygen and ultrapure water move to the water tank 22 through the second pipe 25 including the long pipe 33. When the operation of the electrochemical reaction device 20 is stopped, pure water flows back from the water tank 22 to the second electrode 3. In contrast, when a length of the second pipe 25 including the long pipe 33 is sufficiently long (for example, the length is several tens of times longer than the shortest distance of the second pipe 25), the time for the pure water to reach the second electrode 3 from the water tank 22 can be made longer.

An appropriate length of the second pipe 25 can be calculated using Fick's law from an impurity concentration of water contained in the water tank 22 and a pipe diameter. In other words, a length that impurities in water diffuse through the second pipe 25 to reach the second electrode 3 can be calculated using Fick's law. Therefore, the length of the second pipe 25 including the long pipe 33 should be set so that the specific resistance of the water reaching the second electrode 3 does not fall below 5 MΩ·cm in consideration of the time required for stopping the electrochemical reaction device 20, for example. When the operation is stopped for a longer time, it is preferable to make the pipe length longer. In this way, it is possible to keep the second flow path 13 and the second electrode 3 filled with ultrapure water for a long time by making the length of the second pipe 25 sufficiently long by using the long pipe 33 and making the time required for the pure water to reach the second electrode 3 from the water tank 22 long. Therefore, the deterioration of the electrolytic cell 1 and the electrolytic device 20 can be suppressed.

Fourth Embodiment

Figure 10:
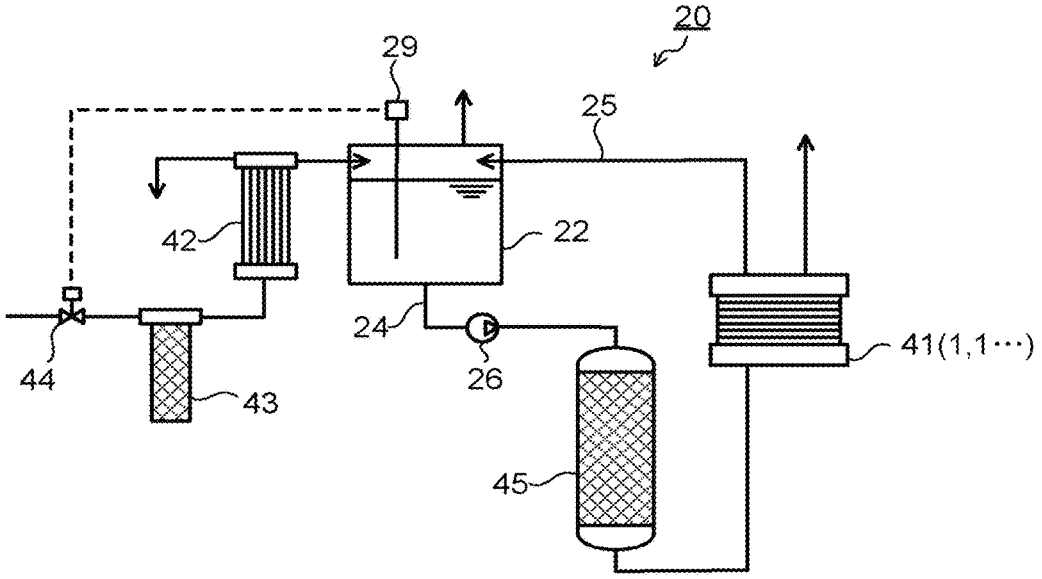
FIG. 10 is a diagram illustrating an electrochemical reaction device according to a fourth embodiment.

The electrochemical reaction device 20 according to a fourth embodiment is described with reference to FIG. 10. In FIG. 10, an electrochemical reaction cell stack 41 is illustrated, which is formed by stacking a plurality of electrochemical reaction cells illustrated in FIG. 1. A basic configuration other than the above is roughly the same as the electrochemical reaction device 20 illustrated in FIG. 2. Differences between the electrochemical reaction device 20 illustrated in FIG. 2 and the electrochemical reaction device 20 illustrated in FIG. 10 are explained mainly below. The electrochemical reaction device 20 illustrated in FIG. 10 includes the water tank 22 as the liquid tank that contains the liquid to be treated supplied to the second flow path of the second electrode, as same as the electrochemical reaction device 20 illustrated in FIG. 2. A reverse osmosis membrane (RO membrane) device 42 and a carbon filter device 43 are connected to the water tank 22 as the pure-water production device. An electromagnetic valve 44, which is electrically connected to the liquid level sensor 29 installed in the water tank 22, is provided at an upstream side of the carbon filter device 43. When the liquid level in the water tank 22 measured by the liquid level sensor 29 falls below the lower limit, the electromagnetic valve 44 is opened to supply pure water to the water tank 22 through the carbon filter device 43 and the RO membrane device 42.

The first pipe 24, which is a water supply pipe to the cell stack 41, is provided with the pump 26 and an ion-exchange resin device 45 as the ultrapure-water production device. Ultrapure water with the specific resistance of 17 MΩ·cm@25° C. or more such as, for example, 18.24 MΩ·cm@25° C. is supplied from the ion-exchange resin device 45 to the second electrode of the cell stack 41. The second pipe 25 that returns oxygen ($O_2$), which is produced by water electrolysis at the cell stack 41, and excess ultrapure water to the water tank 22 is connected to an outlet of the second flow path of the second electrode in the cell stack 41. The second pipe 25 is connected at a position higher than the liquid level in the water tank 22, which is set by the liquid level sensor 29. This prevents the water in the second pipe 25 from flowing back into the cell stack 41 when the operation of the cell stack 41 is stopped.

However, when a stop time of the cell stack 41 is elongated, the water remaining in the second pipe 25 will evaporate and the MEA will dry out. When dry out, the separating membrane shrinks and swells when water is supplied again, and this repeated dry/wet cycle places a mechanical load on the separating membrane, which may cause flow path blockage due to rupture or deformation of the separating membrane, or a decrease in durability of the cell stack 41. From this perspective, the second pipe 25 is preferably connected at a position lower than the liquid level in the water tank 22, which is set by the liquid level sensor 29. However, this alone is not enough to suppress the backflow of the water in the second pipe 25 into the cell stack 41. For such a point, it is preferable to apply a configuration of a fifth or sixth embodiment presented below or other embodiments.

Fifth Embodiment

Figure 11:
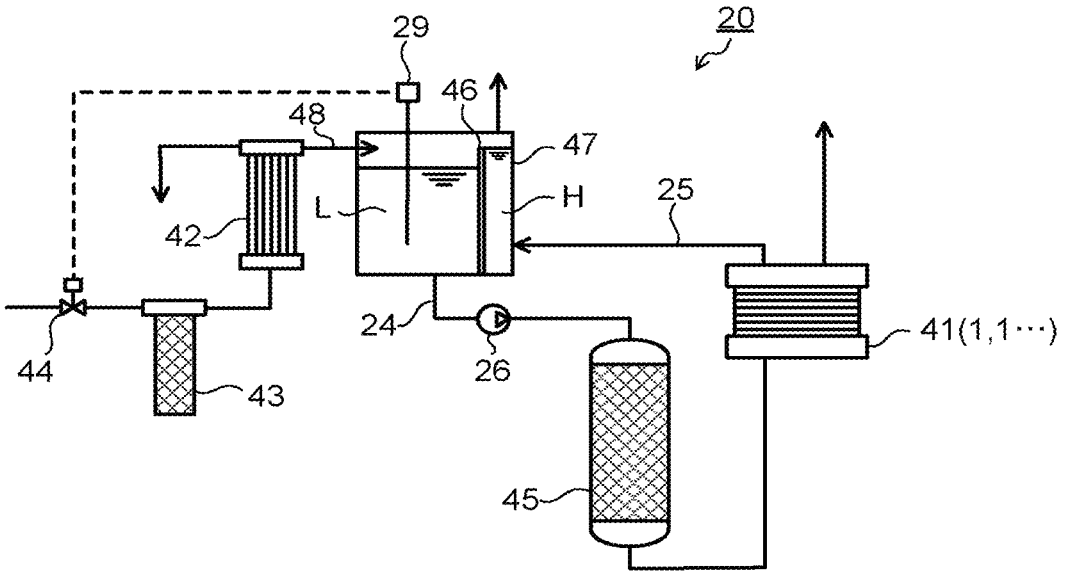
FIG. 11 is a diagram illustrating an electrochemical reaction device according to a fifth embodiment.

The electrochemical reaction device 20 according to the fifth embodiment is described with reference to FIG. 11. The electrochemical reaction device 20 illustrated in FIG. 11 will be explained mainly with respect to differences from the electrochemical reaction device 20 according to the fourth embodiment illustrated in FIG. 10. The electrochemical reaction device 20 illustrated in FIG. 11 is provided with a water tank 47 that has an overflow structure with two tanks separated by an overflow wall 46 into a low water level tank portion L and a high water level tank portion H. In the water tank 47 with the overflow wall 46, one of the two tanks separated by the overflow wall 46 becomes the high water level tank portion H, which is a water inlet side, and the other becomes the low water level tank portion L, which is a water outlet side. A water supply pipe 48 of the RO membrane device 42 is connected to the low water level tank portion L. The pure water (treatment liquid concentrate) produced at the RO membrane device 42 is supplied to the low water level tank portion L. The first pipe 24, which is the water supply pipe to the cell stack 41, is connected to the low water level tank portion L. The second pipe 25, which is a drainage pipe from the cell stack 41, is connected to the high water level tank portion H. The ultrapure water (liquid to be treated) treated in the cell stack 41 is returned to the high water level tank portion H. Furthermore, the second pipe 25 is connected under water below a liquid level of the high water level tank portion H set by the overflow wall 46. This maintains a water seal of the second pipe 25.

In the water tank 47 with the two-tank structure, the water sent to the high water level tank portion H is sent over the overflow wall 46 to the low water level tank portion L. Therefore, the water sent to the high water level tank portion H does not mix with the water stored in the low water level tank portion L. As mentioned above, since the second pipe 25 is connected below the liquid level of the high water level tank portion H, the water returned from the cell stack 41 (ultrapure water with the specific resistance of 17 MΩ·cm or more) does not mix with the water (pure water with the specific resistance of about 0.1 to 5 MΩ·cm) stored in the low water level tank portion L. Therefore, when the operation of the cell stack 41 is stopped, performance of the cell stack 41 does not deteriorate even when the ultrapure water stored in the high water level tank portion H and the ultrapure water in the second pipe 25 flow back into the cell stack 41. That is, the pure water produced at the RO membrane device 42 contains anionic and cationic components, as well as $SiO_2$ and other fine particles although only a small amount. As these enter the separating membrane, they reduce ionic conductance or adsorb onto the catalysts on the first and second electrodes, thereby lowering a reaction area for electrolysis and other electrochemical reactions. However, only ultrapure water flows back into the cell stack 41. In other words, the liquid to be treated (ultrapure water), which contains pure water as the treatment liquid concentrate, does not flow back into the cell stack 41. Therefore, the performance of the cell stack 41 does not deteriorate. It is possible to suppress the deterioration of the cell stack 41 and the electrolytic device 20.

Sixth Embodiment

Figure 12:
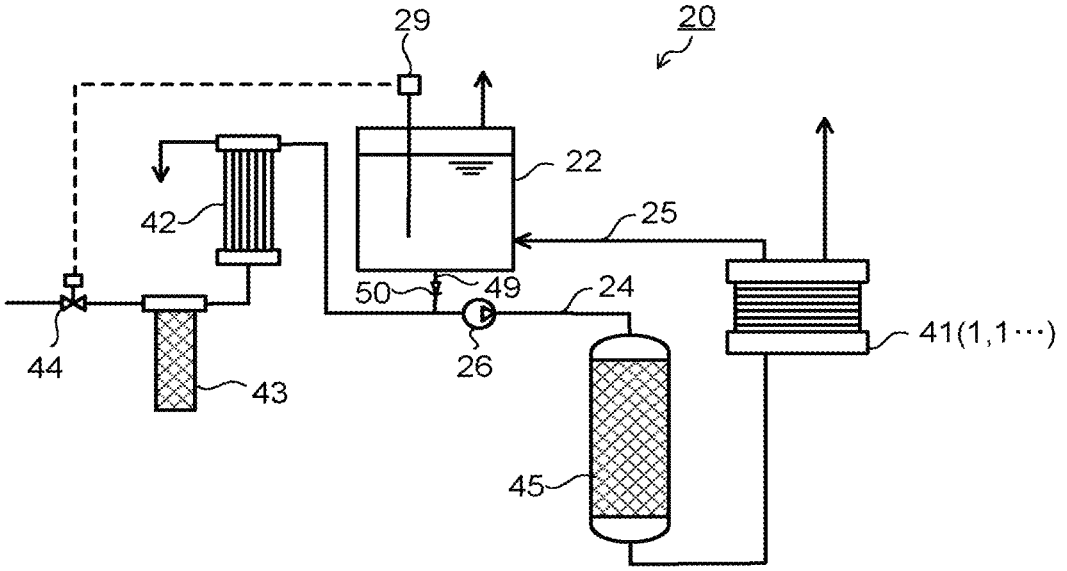
FIG. 12 is a diagram illustrating an electrochemical reaction device according to a sixth embodiment.

The electrochemical reaction device 20 according to the sixth embodiment is described with reference to FIG. 12. The electrochemical reaction device 20 illustrated in FIG. 12 will be explained mainly with respect to differences from the electrochemical reaction devices 20 according to the fourth and fifth embodiments illustrated in FIG. 10 and FIG. 11. In the electrochemical reaction device 20 illustrated in FIG. 12, the RO membrane device 42 is directly connected to the first pipe 24, which is the water supply pipe to the cell stack 41. The first pipe 24 is provided with the pump 26 and the ion-exchange resin device 45. Therefore, the pure water as the treatment liquid concentrate produced at the RO membrane device 42 is directly supplied to the ion-exchange resin device 45, which produces ultrapure water as the liquid to be treated, through the first pipe 24. The second pipe 25, which is the drainage pipe from the cell stack 41, is connected to the water tank 22. A pipe 49 on an outlet side of the water tank 22 is connected to the second pipe 25 on an upstream side than the pump 26. The pipe 49 is provided with a check valve 50.

In the electrochemical reaction device 20 with such a configuration, the pure water produced at the RO membrane device 42 is directly sent to the ion-exchange resin device 45 without going through the water tank 22. The ultrapure water produced at the ion-exchange resin device 45 is sent to the cell stack 41. The water (ultrapure water) discharged from the cell stack 41 is sent to the water tank 22 and then to the cell stack 41 again through the pipe 49 and the ion-exchange resin device 45. At this time, since the pure water produced at the RO membrane device 42 is not sent to the water tank 22, the water stored in the water tank 22 is basically only the ultrapure water, which goes through the cell stack 41. Therefore, when the operation of the cell stack 41 is stopped, performance of the cell stack 41 does not deteriorate because the ultrapure water as the liquid to be treated containing the pure water as the treatment liquid concentrate does not flow back into the cell stack 41 even when the ultrapure water stored in the water tank 22 and the ultrapure water in the second pipe 25 flow back into the cell stack 41, as in the electrochemical reaction device 20 of the fifth embodiment.

Figure 13:
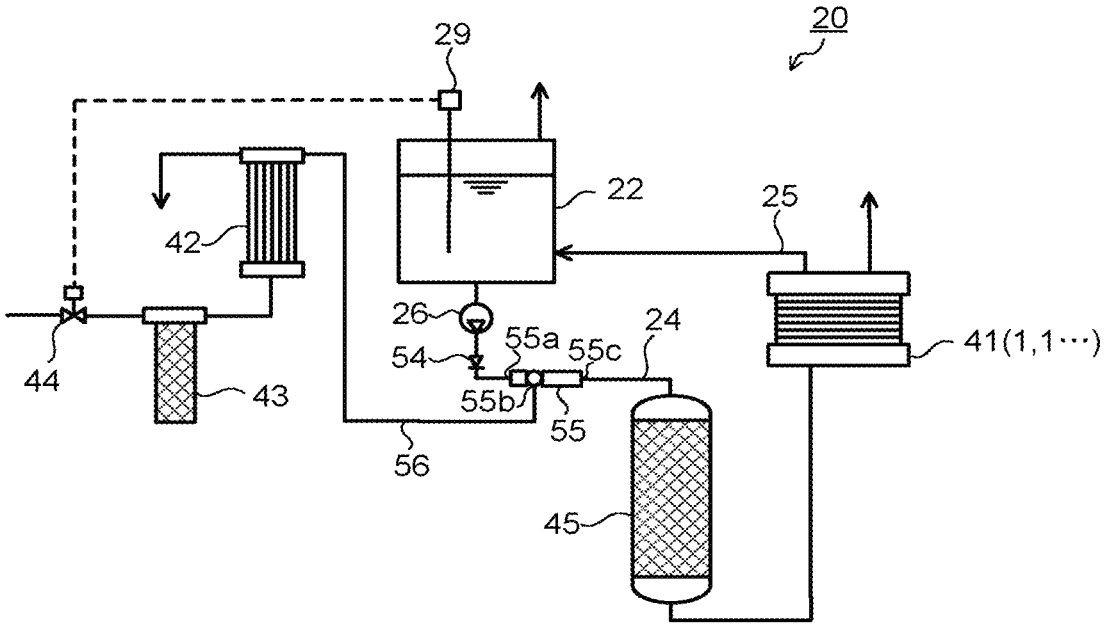
FIG. 13 is a diagram illustrating a modification example of the electrochemical reaction device illustrated in FIG. 12.

The electrochemical reaction device 20 of the sixth embodiment may have a configuration illustrated in FIG. 13. FIG. 13 is a diagram illustrating a modification example of the electrochemical reaction device 20 illustrated in FIG. 12. In the electrochemical reaction device 20 illustrated in FIG. 13, the RO membrane device 42 is connected to the first pipe 24 as same as the electrochemical reaction device 20 illustrated in FIG. 12. In addition to simply connecting the RO membrane device 42 to the first pipe 24, a pipe 56 from the RO membrane device 42 is connected to an injector 55 provided in the first pipe 24, which is connected to the outlet of the water tank 22. The first pipe 24 has the pump 26, a check valve 54, and the injector 55 provided in turn on an upstream side of the ion-exchange resin device 45. The injector 55 is connected to the ion-exchange resin device 45 through the first pipe 24. In FIG. 12, the pump 26 is disposed on a downstream side of a connecting portion between the first pipe 24 and the pipe 56 from the RO membrane device 42, whereas in FIG. 13, the pipe 56 from the RO membrane device 42 is connected on a downstream side of the pump 26 in the first pipe 24.

The injector 55 is a kind of jet pump, with two inlets of an inlet (first inlet) 55*a* for water with relatively high pressure, an inlet (second inlet) 55*b* for water with relatively low pressure, and an outlet 55*c*. The first inlet 55*a* is connected to a water supply port of the pump 26, which discharges water with relatively high pressure. The second inlet 55*b* is connected to a water supply port of the RO membrane device 42, which discharges water with relatively low pressure. Inside the injector 55, the relatively high-pressure water (water discharged from the pump 26/water in the water tank 22) is ejected from a nozzle. The momentum of the ejected water is used to entrain and eject the relatively low-pressure water (water discharged from the RO membrane device 42). This makes it easier to supply the relatively low-pressure water discharged from the RO membrane device 42 to the ion-exchange resin device 45. Furthermore, the injector 55 also has an effect of mixing the relatively high-pressure water with the relatively low-pressure water. These allow the water (RO water) discharged from the RO membrane device 42 to be supplied to the pipe with high pressure and immediate ultrapure water treatment is enabled while maintaining the pressure at the water supply port of the RO membrane device 42 at a low pressure favorable to RO membrane treatment. Therefore, contamination of the electrochemical reaction device 1 can be effectively suppressed because retention of the RO water with relatively low purity in the system can be minimized.

Seventh Embodiment

Figure 14:
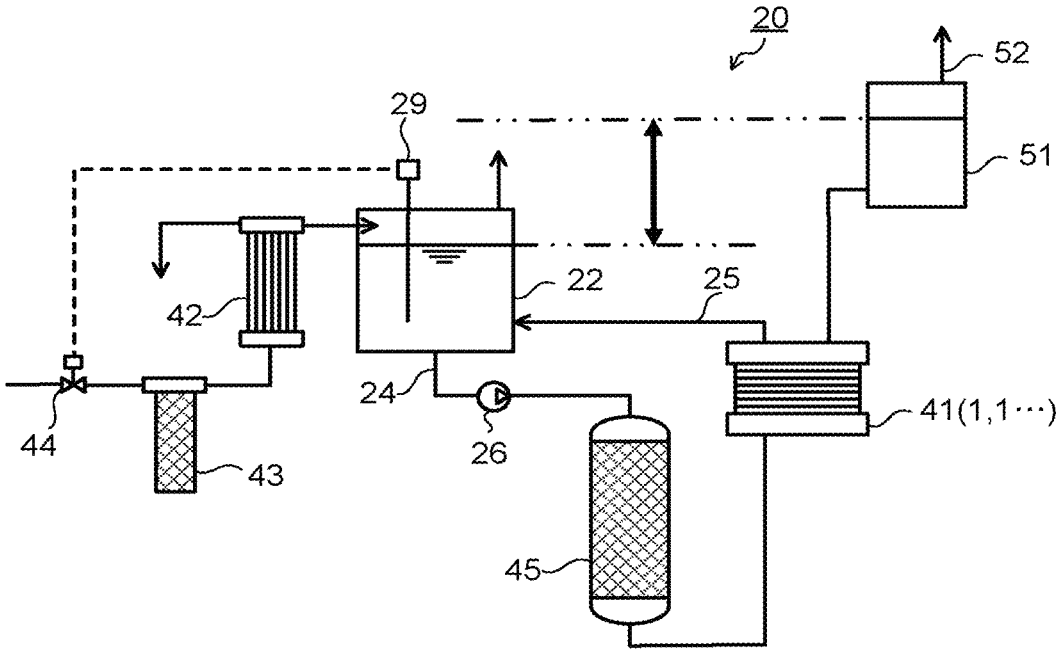
FIG. 14 is a diagram illustrating an example of an electrochemical reaction device according to a seventh embodiment.
Figure 15:
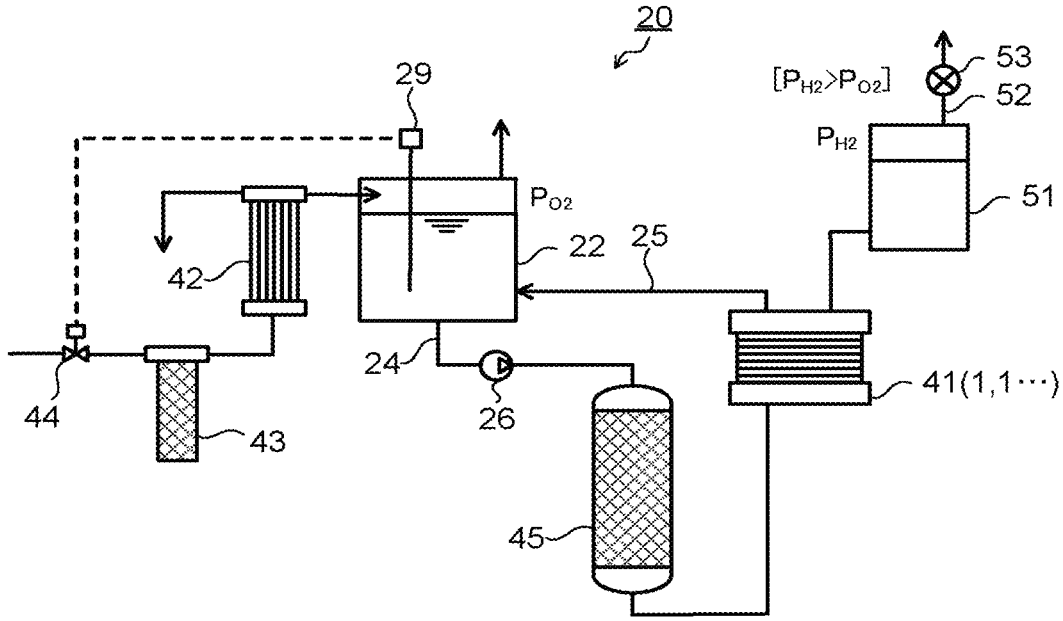
FIG. 15 is a diagram illustrating another example of the electrochemical reaction device according to the seventh embodiment.

The electrochemical reaction device 20 according to a seventh embodiment is described with reference to FIG. 14 and FIG. 15. The electrochemical reaction devices 20 illustrated in FIG. 14 and FIG. 15 are explained mainly with respect to differences from the electrochemical reaction devices 20 according to the fourth and fifth embodiments illustrated in FIG. 10 and FIG. 11. In the electrochemical reaction devices 20 illustrated in FIG. 14 and FIG. 15, a second water tank (gas-liquid separation tank) 51 having a gas-liquid separation function is connected to an outlet of the first flow path of the first electrode of the cell stack 41. Hydrogen ($H_2$), which is produced by water electrolysis, and excess water are sent from the first electrode of the cell stack 41 to the second water tank (gas-liquid separation tank) 51. The configuration or the like of the water tank (first water tank) 22 is similar to the electrochemical reaction device 20 of the fourth embodiment illustrated in FIG. 10, except that the second pipe 25 is connected below the water surface of the first water tank 22.

The following are possible factors that cause water stored in the water tank 22 and water in the second pipe 25 to flow back into the cell stack 41 when the operation of the cell stack 41 is stopped. That is, when the operation of the cell stack 41 is stopped, water flows from the second electrode to the first electrode through the separating membrane. This means that when the operation of the cell stack 41 is stopped, the water stored in the water tank 22 and the water in the second pipe 25 may flow back into the cell stack 41. To prevent such backflow of water in the water tank 22 and the second pipe 25 into the cell stack 41, the flow of water from the second electrode to the first electrode through the separating membrane should be inhibited when the operation of the cell stack 41 is stopped.

Therefore, in the electrochemical reaction device 20 illustrated in FIG. 14, the second water tank (gas-liquid separation tank) 51 is installed so that the liquid level of the second water tank 51 is higher than that of the first water tank 22. Based on such static positions of the second water tank 51 and the first water tank 22, an internal pressure of the second water tank 51 is higher than that of the first water tank 22. Therefore, the water in the first water tank 22 and the second pipe 25 can be prevented from flowing back into the cell stack 41 when the operation of the cell stack 41 is stopped. In the electrochemical reaction device 20 illustrated in FIG. 15, a valve 53 is provided in a gas discharge pipe 52 of the second water tank 51, and opening/closing operation of the valve 53 is controlled to make the internal pressure of the second water tank 51 higher than that of the first water tank 22. It is also possible to suppress that the water in the first water tank 22 and the second pipe 25 flow back into the cell stack 41 when the operation of the cell stack 41 is stopped by applying such a configuration to make an internal pressure $P_{H2}$ of the second water tank 51 higher than an internal pressure $P_{O2}$ of the first water tank 22.

EXAMPLES

Next, examples and evaluation results thereof will be described.

Example 1

Figure 2:
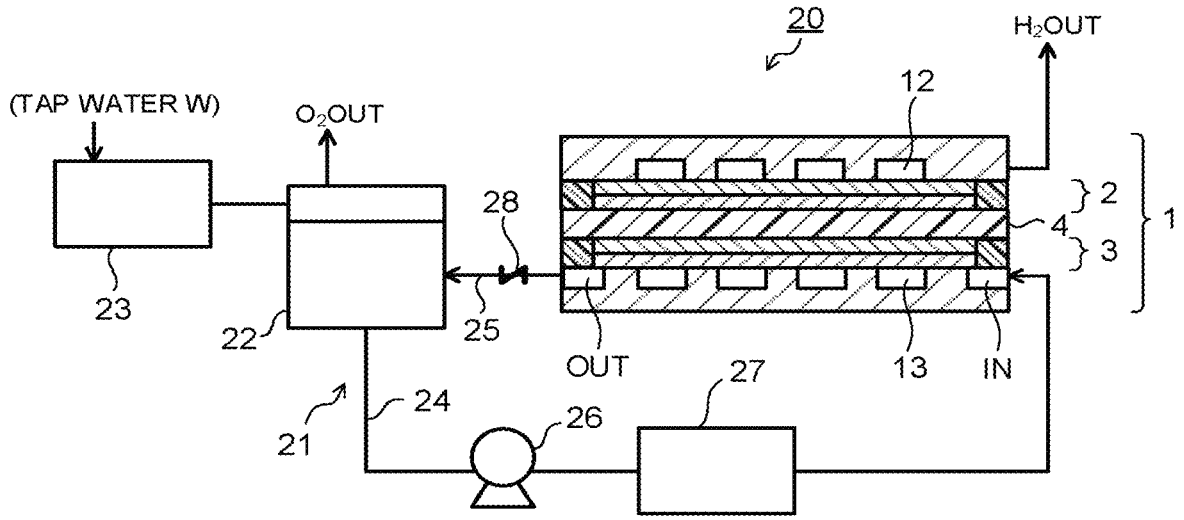
FIG. 2 is a diagram illustrating the electrochemical reaction device according to a first embodiment.

As illustrated in FIG. 2, the electrochemical reaction device (electrolytic device) 20 was configured where the water tank 22 and the second flow path 13 of the second electrode 3 in the electrochemical reaction cell (electrolytic cell) 1 were connected by the second pipe 25 provided with the check valve 28. When the device was in operation, oxygen produced at the second electrode 3 and ultrapure water were sent to the water tank 22 through the second pipe 25. On the other hand, when the device was stopped, water in the water tank 22 did not flow back to the second electrode 3 due to the check valve 28. At this time, a level difference of the check valve 28 installed below the liquid level of the water tank 22 was 30 cm and a minimum operating pressure of the check valve 28 based on expression (3) was preferably set to 3 kPa or more. Therefore, in Example 1, a ball-type check valve with the minimum operating pressure of 5 kPa was used.

In the electrochemical reaction device 20 having such a configuration, a specific resistance meter was installed at a portion between the check valve 28 of the second pipe 25 and the second flow path 13 to ensure that water quality did not drop significantly from 18.24 MΩ·cm when the device was stopped. A process of operating the device at 50 A for one hour and thereafter stopping for 24 hours was set to one time, and the process was repeated 300 times while using such a device. In an initial operation of the device, a voltage was 1.85 V, and a current density was 2 A/cm$^2$. In contrast, it was confirmed that the voltage and current density remained at 1.87 V and 2 A/cm$^2$, respectively, after 300 repetitions.

Example 2

Figure 6:
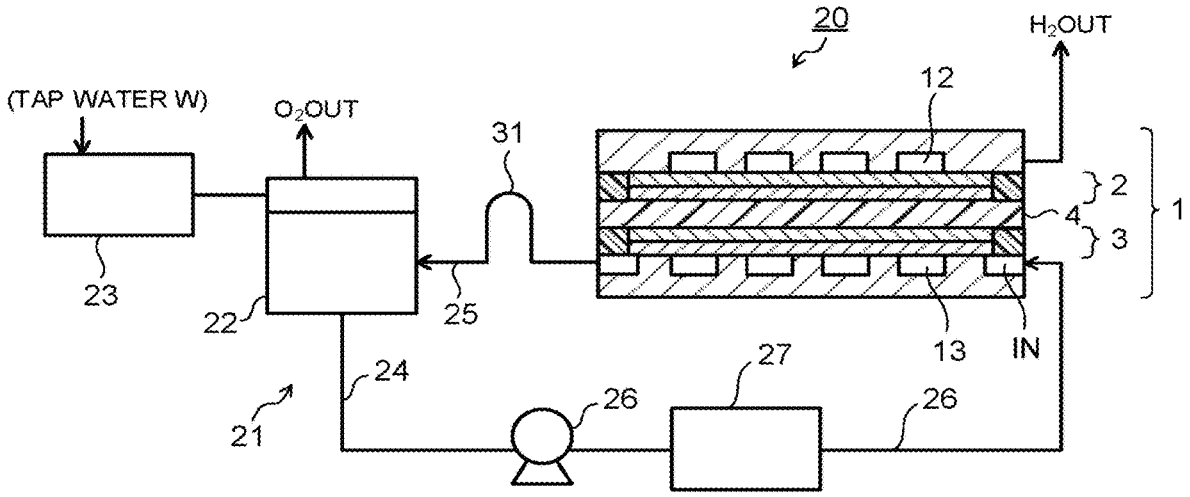
FIG. 6 is a diagram illustrating an electrochemical reaction device according to a second embodiment.
Figure 7:
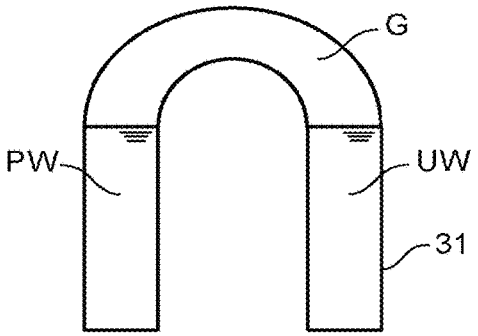
FIG. 7 is a diagram illustrating a part of a first example of the electrochemical reaction device according to the second embodiment.

The U-shaped pipe 31 was installed in the second pipe 25 between the water tank 22 and the second flow path 13 in the electrochemical reaction cell (electrolytic cell) 1 as illustrated in FIG. 6 so that the U-shaped pipe 31 was convex upward. When the device was in operation, oxygen produced at the second electrode 3 and ultrapure water were sent to the water tank 22 through the second pipe 25. On the other hand, when the device was stopped, the pump 26 was also stopped immediately after the electrolysis was stopped, resulting in forming a gas accumulation inside the U-shaped pipe 31 due to the produced gas. This prevented water in the water tank 22 from flowing back to the second electrode 3 because the liquid junction was broken by the gas accumulation.

In the electrochemical reaction device 20 having such a configuration, a specific resistance meter was installed at a portion of the second pipe 25 where water was accumulated on the second electrode 3 side than the gas accumulation in the U-shaped pipe 31, to ensure that water quality did not drop significantly from 18.24 MΩ·cm when the device was stopped. A process of operating the device at 50 A for one hour and thereafter stopping for 24 hours was set to one time, and the process was repeated 300 times while using such a device. In an initial operation of the device, the voltage was 1.85 V, and the current density was 2 A/cm$^2$. In contrast, it was confirmed that the voltage and current density remained at 1.87 V and 2 A/cm$^2$, respectively, after 300 repetitions.

Example 3

Figure 8:
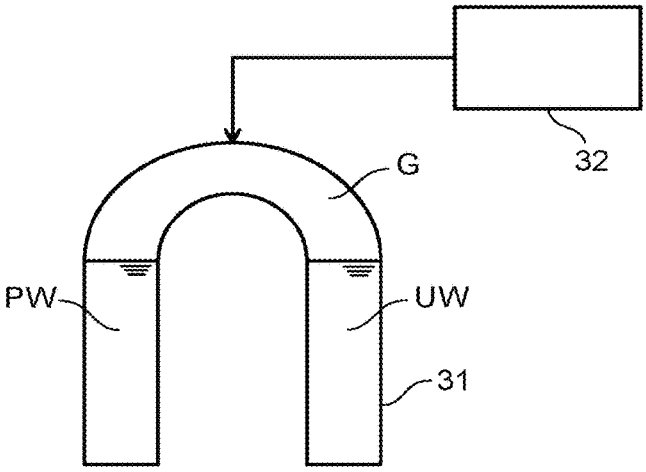
FIG. 8 is a diagram illustrating a part of a second example of the electrochemical reaction device according to the second embodiment.

The U-shaped pipe 31 was installed in the second pipe 25 between the water tank 22 and the second flow path 13 in the electrochemical reaction cell (electrolytic cell) 1 so that the U-shaped pipe 31 was convex upward as illustrated in FIG. 6 and FIG. 8. Furthermore, the gas supply unit 32 was connected to an upper part of the U-shaped pipe 31 so that gas can be supplied to the U-shaped pipe 31 from the outside. When the device was in operation, oxygen produced at the second electrode 3 and ultrapure water were sent to the water tank 22 through the second pipe 25. On the other hand, when the device was stopped, the pump 26 was operated for a while immediately after the electrolysis was stopped, and then gas was injected from the outside into the inside of the U-shaped pipe 31 to form a gas accumulation. This prevented water in the water tank 22 from flowing back to the second electrode 3 because the liquid junction was broken by the gas accumulation.

In the electrochemical reaction device 20 having such a configuration, a specific resistance meter was installed at a portion of the second pipe 25 where water was accumulated on the second electrode 3 side than the gas accumulation in the U-shaped pipe 31, to ensure that water quality did not drop significantly from 18.24 MΩ·cm when the device was stopped. A process of operating the device at 50 A for one hour and thereafter stopping for 24 hours was set to one time, and the process was repeated 300 times while using such a device. In an initial operation of the device, the voltage was 1.85 V, and the current density was 2 A/cm$^2$. In contrast, it was confirmed that the voltage and current density remained at 1.87 V and 2 A/cm$^2$, respectively, after 300 repetitions.

Example 4

The long pipe 33 was installed in the second pipe 25 between the water tank 22 and the second flow path 13 in the electrochemical reaction cell (electrolytic cell) 1. Assuming an impurity concentration of 2 ppm in water in the water tank 22 and 1 inch in pipe diameter, a required pipe length was calculated from Fick's law. In Example 4, the pipe length of the second pipe 25 including the long pipe 33 was set to 2 m as a sufficient length to prevent the specific resistance from falling too low in 24 hours.

In the electrochemical reaction device 20 having such a configuration, a specific resistance meter was installed at a portion near the second flow path 13 in the second pipe 25, concretely, at a distance of 5 cm from the second flow path 13, to ensure that water quality of the water tank 22 did not drop to 0.1 MΩ·cm, such as 15 MΩ·cm in 3 hours, 10 MΩ·cm in 12 hours, and 7 MΩ·cm in 24 hours. A process of operating the device at 50 A for one hour and thereafter stopping for 24 hours was set to one time, and the process was repeated 300 times while using such a device. In an initial operation of the device, the voltage was 1.85 V, and the current density was 2 A/cm$^2$. In contrast, it was confirmed that the voltage and current density remained at 1.89 V and 2 A/cm$^2$, respectively, after 300 repetitions.

Comparative Example 1

Figure 9:
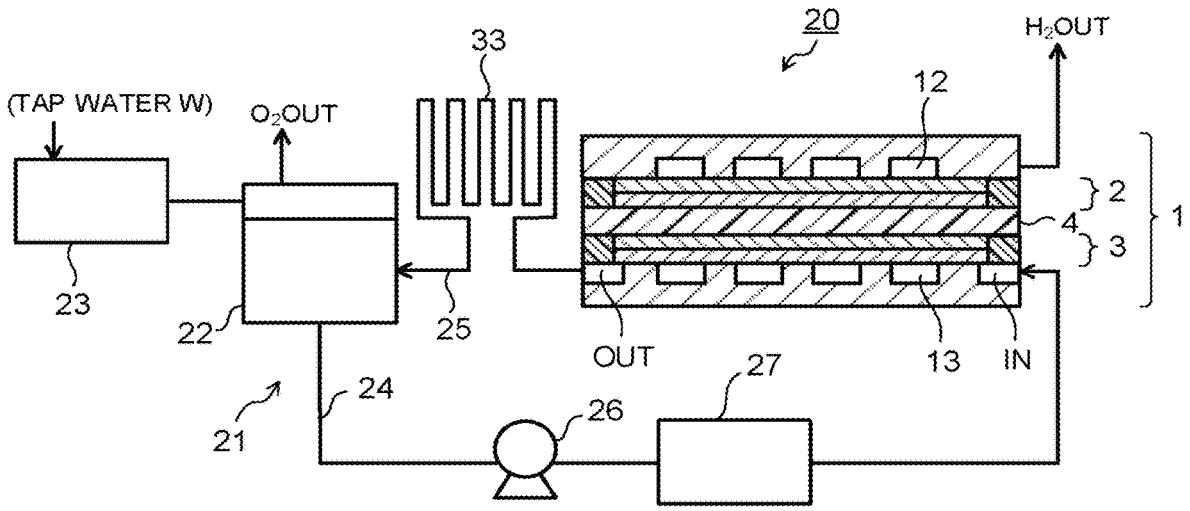
FIG. 9 is a diagram illustrating an electrochemical reaction device according to a third embodiment.

In each of FIG. 2, FIG. 6, and FIG. 9, the electrochemical reaction device 20 was configured by connecting from the water tank 22 to the second flow path 13 with the second pipe 25, which was the shortest distance and has no backflow suppression mechanism. In the electrochemical reaction device 20 having such a configuration, a specific resistance meter was installed between the water tank 22 and the second flow path 13 when the device was stopped to measure the specific resistance of water after the device was stopped. As a result, the specific resistance of the water was confirmed to decrease to about 1 MΩ·cm in about 3 hours and 0.1 MΩ·cm in 12 hours. This indicated that the water in the water tank 22 was flowing back into the MEA 9. While using such a device, 300 times operations were repeated under the same conditions as in Example 1. In an initial operation of the device, the voltage was 1.85 V, and the current density was 2 A/cm$^2$. In contrast, the voltage increased to 2.25 V and the current density was 2 A/cm$^2$, after 300 repetitions. These results confirmed that the electrolytic cell 1 was deteriorating due to the backflow of the water tank 22 when the device was stopped.

Note that the above-described configurations in the embodiments are applicable in combination, and parts thereof are also replaceable. While certain embodiments have been described, these embodiments have been presented by way of example only, and are not intended to limit the scope of the inventions. Indeed, the embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

What is claimed is:

1. An electrochemical reaction device, comprising:

an electrochemical reaction cell that includes a first electrode having a first flow path, a second electrode having a second flow path, and a separating membrane sandwiched between the first electrode and the second electrode and having a polymer electrolyte membrane;

a liquid to be treated supply system that includes a pure-water production unit to produce pure water and an ultrapure-water production unit to produce ultrapure water by treating the pure water supplied from the pure-water production unit, and supplies the ultrapure water to the electrochemical reaction cell as a liquid to be treated; and a liquid tank configured to receive the ultrapure water to be supplied from the electrochemical reaction cell and to be treated in the electrochemical reaction cell and the pure water to be supplied from the pure-water production unit, wherein the liquid to be treated supply system includes a pure water and treated ultrapure water backflow suppression mechanism that suppresses backflow of the pure water and the treated ultrapure water in the liquid tank, from the liquid tank into the electrochemical reaction cell.

2. The device according to claim 1, wherein the liquid tank has an overflow structure with two tanks separated by an overflow wall into a low water level tank portion and a high water level tank portion, a pipe that supplies the pure water from the pure-water production unit to the ultrapure-water production unit is connected to the low water level tank portion of the liquid tank, and the pure water is supplied to the ultrapure-water production unit through the low water level tank portion of the liquid tank, and a pipe that returns the liquid to be treated from the electrochemical reaction cell to the liquid tank is connected to the high water level tank portion of the liquid tank.

3. The electrochemical reaction device according to claim 1, wherein a supply pipe that supplies the pure water from the pure-water production unit to the ultrapure-water production unit is directly connected to the ultrapure-water production unit, and a pipe that returns the liquid to be treated from the electrochemical reaction cell to the liquid tank is connected to the liquid tank, and a pipe that supplies the liquid to be treated from the liquid tank to the electrochemical reaction cell is connected to the supply pipe at an upstream side than the ultrapure-water production unit through a check valve.

4. The device according to claim 1, wherein a pipe that supplies the liquid to be treated from the liquid tank to the electrochemical reaction cell is connected to the ultrapure-water production unit through a pump and an injector, and a water supply port that discharges the pure water from the pure-water production unit is connected to the injector.

5. The device according to claim 1, wherein the liquid tank has:

a first inlet through which the ultrapure water to be supplied from the electrochemical reaction cell flows; and a second inlet through which the pure water to be supplied from the pure-water production unit flows.

* * * * *